United States Patent [19]

Spindt et al.

[11] Patent Number: 4,857,799

[45] Date of Patent: Aug. 15, 1989

[54] MATRIX-ADDRESSED FLAT PANEL DISPLAY

[75] Inventors: Charles A. Spindt, Menlo Park; Christopher E. Holland, Redwood City, both of Calif.

[73] Assignee: SRI International, Menlo Park, Calif.

[21] Appl. No.: 891,853

[22] Filed: Jul. 30, 1986

[51] Int. Cl.[4] ..... H01J 1/62

[52] U.S. Cl. ..... 313/495; 313/496; 313/497; 313/422; 313/309; 315/169.3; 340/752; 340/783

[58] Field of Search ..... 313/495, 496, 497, 422, 313/336, 351, 309; 340/752, 760, 781, 783, 785; 315/169.3

[56] References Cited

U.S. PATENT DOCUMENTS

| | | | |
|---|---|---|---|
| 3,665,241 | 5/1972 | Spindt et al. | 313/309 |
| 3,755,704 | 8/1973 | Spindt et al. | 313/309 |
| 3,855,499 | 12/1974 | Yamada et al. | 313/497 |
| 3,970,887 | 7/1976 | Smith et al. | 313/309 |
| 4,160,191 | 7/1979 | Hausfeld | 313/598 X |
| 4,451,759 | 5/1984 | Heynisch | 313/495 |
| 4,459,514 | 7/1984 | Morimoto et al. | 340/781 X |
| 4,554,564 | 11/1985 | Van Gorkom et al. | 313/422 X |
| 4,575,765 | 3/1986 | Hirt | 340/781 X |

FOREIGN PATENT DOCUMENTS

| | | | |
|---|---|---|---|
| 107217 | 5/1984 | European Pat. Off. . | |
| 0172089 | 2/1986 | European Pat. Off. | 313/496 |
| 3035988 | 4/1982 | Fed. Rep. of Germany | 313/422 |
| 3339696 | 4/1984 | Fed. Rep. of Germany | 313/422 |

OTHER PUBLICATIONS

Gallagher, "Flat-Panel Display Built that Could Compete with CRT's", Electronics, vol. 59, No. 24, p. 18 (New York, U.S.).

*Primary Examiner*—David K. Moore
*Assistant Examiner*—Michael Horabik
*Attorney, Agent, or Firm*—Cushman, Darby & Cushman

[57] ABSTRACT

A matrix-addressed flat panel display is described, utilizing cathodes of the field emission type. The cathodes are incorporated into the display backing structure, and energize corresponding cathodoluminescent areas on a face plate. The face plate is spaced 40 microns from the cathode arrangement in the preferred embodiment, and a vacuum is provided in the space between the plate and such cathodes. Spacers in the form of legs interspersed among the pixels maintain the spacing, and electrical connections for the bases of the cathodes are diffused sections through the backing structure.

12 Claims, 4 Drawing Sheets

FIG. 2
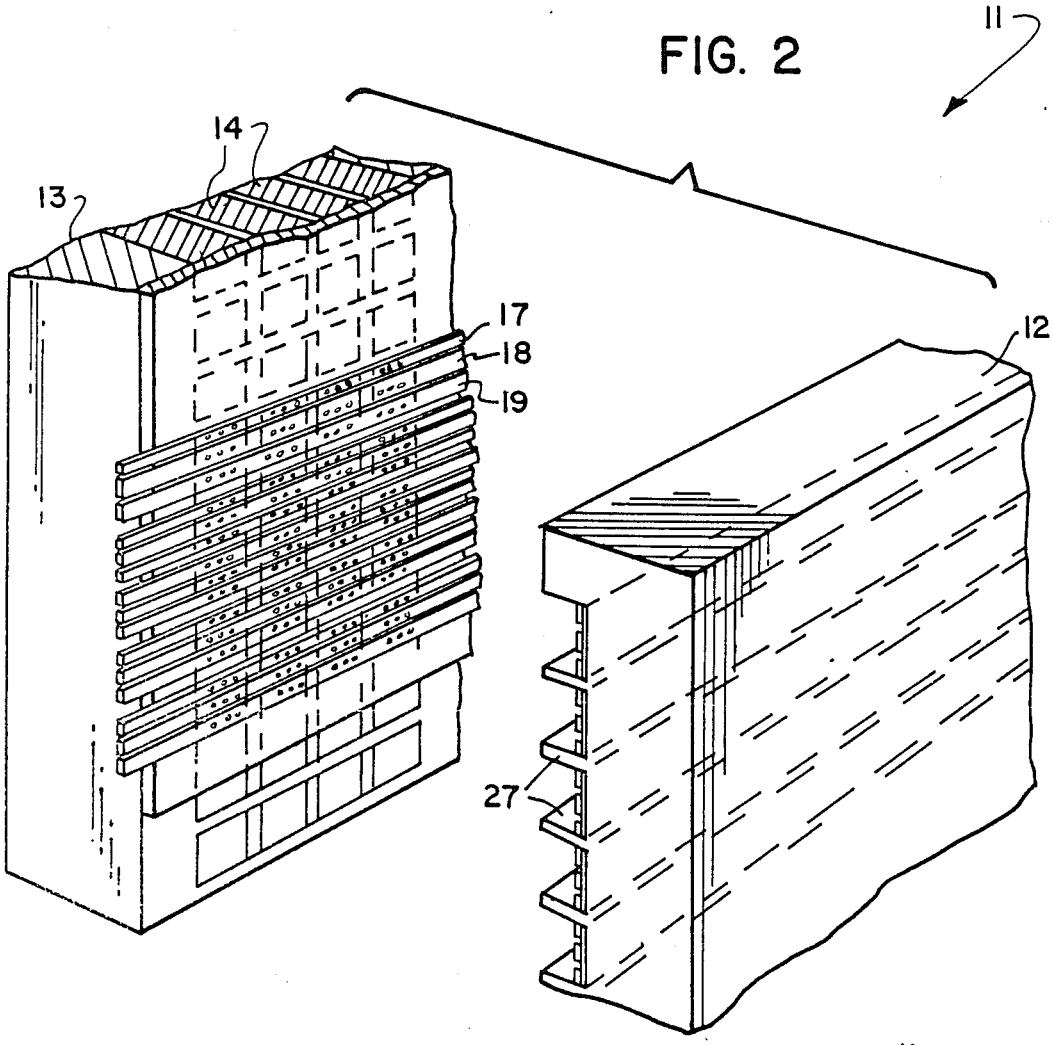
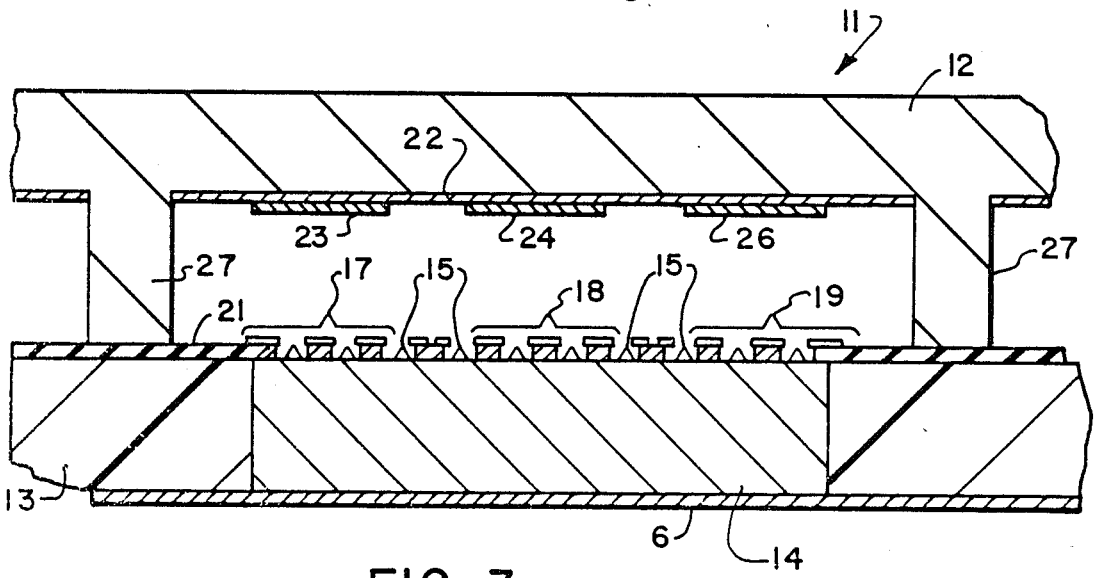
FIG. 3

MATRIX-ADDRESSED FLAT PANEL DISPLAY

BACKGROUND OF THE INVENTION

The present invention relates to flat panel displays and, more particularly, to a matrix-addressed flat panel display utilizing field emission cathodes.

Cathode ray tubes (CRTs) are used in display monitors for computers, television sets, etc. to visually display information. This wide usage is because of the favorable quality of the display that is achievable with cathode ray tubes, i.e., color, brightness, contrast, and resolution. One major feature of a CRT permitting these qualities to be achieved, is the use of a luminescent phosphor coating on a transparent face. Conventional CRTs, however, have the disadvantage that they require significant physical depth, i.e., space behind the actual display screen, making them large and cumbersome. There are a number of important applications in which such requirement is deleterious. For example, the depth available for many compact portable computer displays and operational displays preclude the use of CRTs as displays. Thus, there has been significant interest and much research and development expended in an effort to provide satisfactory so-called "flat panel displays" or "quasi flat panel displays" not having the depth requirement of a typical CRT while having comparable or better display characteristics, e.g., brightness, resolution, versatility in display, power requirements, etc. These attempts, while producing flat panel displays that are useful for some applications have not produced a display that can compare to a conventional CRT.

SUMMARY OF THE INVENTION

The present invention relates to a flat panel display arrangement which employs the advantages of a luminescent phosphor of the type used in CRTs, while maintaining a physically thin display. It includes a matrix array of individually addressable light generating means, preferably of the cathodoluminescent type having cathodes combined with luminescing means of the CRT type which reacts to electron bombardment by emitting visible light. Each cathode preferably is itself an array of thin film field emission cathodes and the luminescing means preferably is provided as a coating on a transparent face plate which is closely spaced to such cathodes. The close spacing (hereinafter sometimes the "interelectrode" spacing) is important not only in providing the desired thinness to the entire display, but also to assure that high resolution is achieved. That is, because there is a short distance between the source of electrons and the display screen the tendency of electrons to follow any path other than a desired path is reduced, resulting in clear, sharp pixels.

This invention does not represent the first effort to combine thin film field emission cathodes with a transparent face in order to obtain a flat panel display. U.S. Pat. No. 3,500,102 issued Mar. 10th, 1970 to Crost et al, broadly discloses such an arrangement. While the Crost et al patent does disclose the broad concept, the construction is not one which will provide a satisfactory display. This patent does not discuss the importance of preventing a gaseous breakdown or avalanche from occurring in the interelectrode space, nor how to inhibit the same. Moreover, it is believed that a practical flat panel display made in accordance with the teachings of the Crost et al patent will exhibit significant distortion on the screen, in view of deflection of the transparent face due to the force of atmospheric pressure on the evacuated structure. The issue of electrical isolation between adjacent cathode bases in the array also is not addressed.

As a significant feature of the instant invention, it includes support structure for maintaining the transparent structure having the luminescing means at a fixed, predetermined location, without deleterious dimensional changes being caused by pressure differentials. It accomplishes this without noticeably interfering with the visual display. In this connection, it most desirably includes spacers which are interspersed between the cathode elements of the array.

Another significant feature of the instant invention is that the spacing between the luminescing means and the cathodes is selected to be equal to or less than the mean free path of electrons at the pressure in the interelectrode space. This close proximity significantly reduces the probability of a gaseous breakdown or ionization avalanche. That is, it significantly reduces the probability of ionization of gas molecules in the interelectrode space which could lead to such a breakdown or avalanche.

The invention further includes an electrical connection structure for each of the pixels which enables the desired matrix-addressing with the minimum interelectrode spacing associated with field emission type cathodes. That is, the bases of the cathodes extend through the backing structure to distribute the electrical connections required outside of the sealed, evacuated environment, thus facilitating electrical contact between the cathodes and the drive electronics. This is particularly advantageous in a flat panel display having a cathode array because of the large number of cathodes and close spacing between them. An important aspect of this arrangement is that steps are taken to prevent electrical "cross-talk" between adjacent cathodes. The backing structure most desirably is of a semiconductive material, such as of silicon, and the individual electrical connections for each of the bases is a conductive section, such as a diffused region, through the semiconductive material. The semiconductive material is an n type material, whereas the conductive sections for the cathodes are p type, with the result that when a negative electrical potential is applied to any particular cathode conductive section, a reverse bias pn junction is formed which automatically isolates the conductive section electrically from the remainder of the same in the backing and thereby provides an insulation barrier.

BRIEF DESCRIPTION OF THE DRAWINGS

With reference to the accompanying three sheets of drawing:

FIG. 2 is an enlarged, partially exploded view of the preferred embodiment of the invention shown in FIG. 1;

FIG. 3 is an enlarged sectional view illustrating a single pixel of the preferred embodiment;

Detailed Description of the Preferred Embodiment

Figure 1:
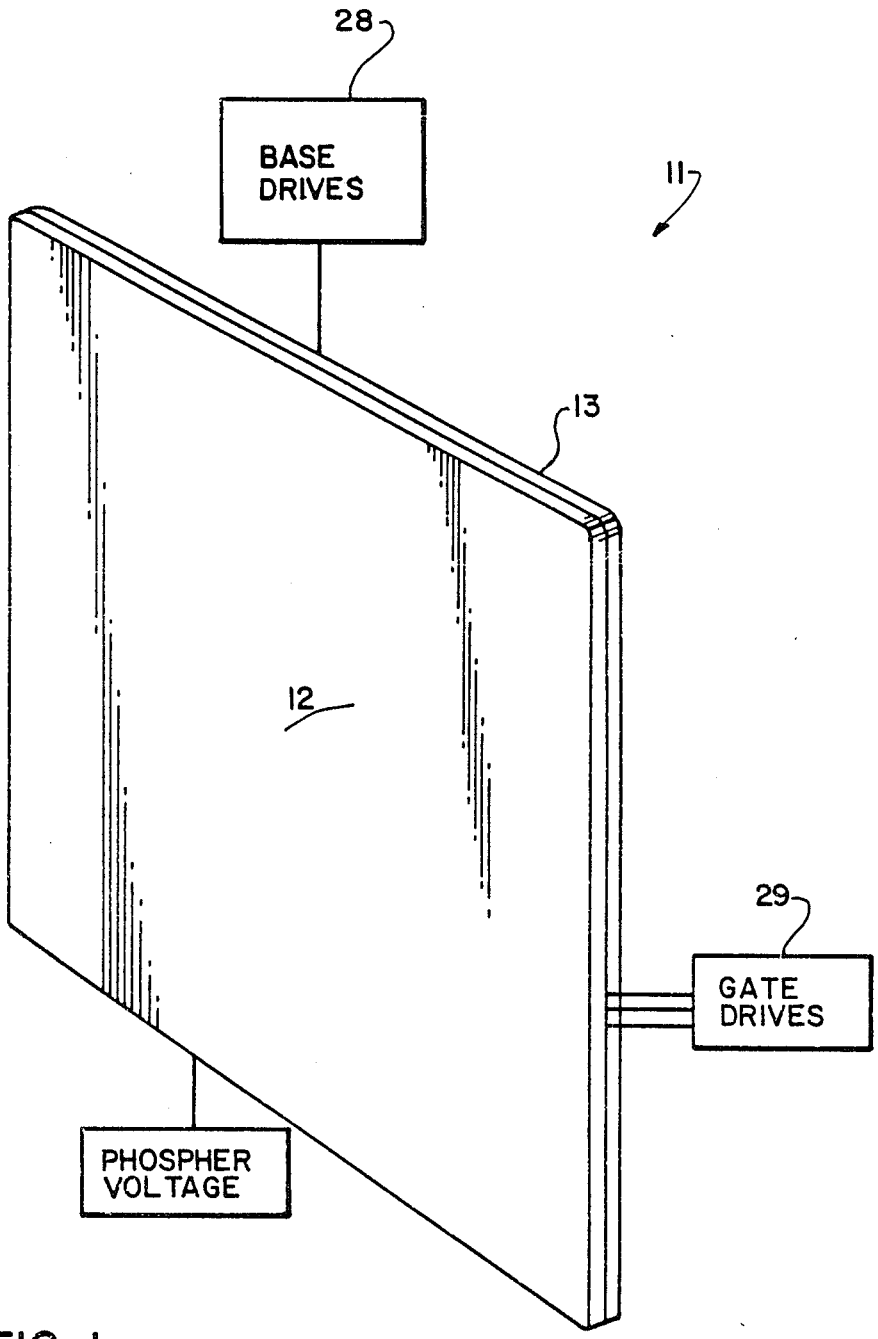
FIG. 1 is an overall isometric and schematic view of a preferred embodiment of the display panel of the invention.

Reference is made to FIGS. 1 through 4 for an understanding of a preferred embodiment of the flat panel display of the invention. A simplified representation of the preferred embodiment is generally referred to by the reference numeral 11. It includes a transparent face plate or structure 12 and a backing plate or structure 13. A matrix array of cathodes is provided between the backing and face plates. Each of the cathodes consists of an array of field emitter tips 15 with integrated extraction electrodes of the type described in, for example, U.S. Pat. Nos. 3,665,241; 3,755,704; and 3,791,471, the disclosures of which are hereby incorporated by reference and all of which name one of the instant inventors, Charles A. Spindt, as an inventor. Three of such cathodes are incorporated in each pixel, one for each of the three primary colors—red, green and blue.

The manner in which such cathodes are incorporated in the preferred embodiment of the invention is best illustrated by FIG. 2. In this connection, one advantage of utilizing field emission type cathodes is that they can be directly incorporated into the backing plate, one of the plates which define the vacuum space. The preferred embodiment being described is designed for chromatic displays and, pursuant thereto, as aforesaid each pixel includes three separate cathodes. The backing structure 13 can be of a semiconductive material, such as silicon, and the three cathodes of each pixel are provided with a common base 14 which is an electrically conductive section extending through the backing structure and provided by, for example, standard diffusion or thermal migration (a form of diffusion) techniques. The provision of this base for the electrodes extending through the backing structure facilitates electrical connection of a matrix driver through the vacuum structure to the bases. Such connection can be, for example, via thin stripes 6 of an electrically conductive metal or the like on the exterior of the backing as illustrated in FIG. 3. As mentioned previously, if the backing structure is a semiconductive material it should be of an n type with electrically conductive regions of a p type providing the electrical connections through such backing structure. When a negative electrical potential is then provided to a p type region, a reverse bias pn junction is formed adjacent the boundary of the region to thereby isolate and electrically insulate the p type region from other p type, conductive regions. While the use of reverse bias pn junctions to isolate conductive regions in a semiconductive material is not new, per se, its use as an aspect of this invention is particularly advantageous because it aids in arriving at the close spacing of adjacent cathodes that is required to obtain acceptable resolution in a flat panel display. The conductive material providing the conductive regions could be, for example, aluminum, diffused through the semiconductive material. It should be noted, however, that the backing structure could be of a material other than silicon or even another semiconductive material. For example, it could be a glass which allows for electrical contacts on or through the same.

As illustrated, each cathode includes a multitude of spaced apart electron emitting tips 15 which project upwardly therefrom toward the face structure 12. As a general rule, each color element will include one to several hundred of such tips depending on the size of the display and the resolution desired - for practical reasons a true representation of the same could not be included in the drawing. An electrically conductive gate or extraction electrode arrangement is positioned adjacent the tips to generate and control electron emission from the latter. Such arrangement is orthogonal to the base stripes and includes apertures through which electrons emitted by the tips may pass. There are three different gates 17, 18 and 19 (see FIG. 3) in each pixel, one for each of the primary colors. As best illustrated in FIG. 2, gates 17–19 are formed as stripes to be common to a full row of pixels extending horizontally as viewed in FIG. 2 across the front face of the backing structure. Such gate electrodes may be simply provided by conventional, optical lithographic techniques on an electrical insulating layer 21 which electrically separates the gates of each pixel from the common base.

The anode of each pixel in this preferred embodiment is a thin coating or film 22 of an electrically conductive transparent material, such as indium tin oxide. The anode for each pixel covers the interior surface of the face plate, except for those areas having the spacers described below.

Phosphor-coated stripes 23, 24, and 26 providing the primary colors are deposited on the layer 22. Each of such stripes opposes a respective one of the gate stripes 17, 18 and 19 and likewise extends for a plurality of pixels.

A vacuum is provided between the location of the electrode gates and the phosphor stripes. The degree of vacuum should be such that deleterious electron avalanche (Pashen) ionization breakdown and secondary electron production is prevented at the given cathode-phosphor spacing and other physical dimensions. As previously mentioned, most desirably the interelectrode spacing is equal to or less than the mean free path of electrons at the pressure in the interelectrode space. This close proximity significantly reduces the probability of ionization of gas molecules in the interelectrode space, thereby inhibiting the possibility of a gaseous breakdown or avalanche.

It should be noted that close cathode-phosphor spacing enables the gate structure to act as a reflective surface behind each pixel to increase the effective brightness. This eliminates the necessity of including a reflective layer over the phosphor, such as of aluminum, that must be penetrated by electrons to activate the display.

It will be recognized that because of the vacuum there will be significant atmospheric pressure on the flat panel display tending to distort the same and reduce the distance between the backing structure and face plate. Pursuant to the invention, support structure is provided to resist such loading and maintain the selected distance between the face and the array of pixel cathodes. Such support structure includes spacers 27 which are elongated, parallel legs integrally connected with the face plate to be interspersed between adjacent rows of pixels. Such legs can be interspersed between the pixels without deleteriously affecting the visual display resolution and quality. As illustrated in the enlarged view of FIG. 3, the legs 27 simply abut the backing structure 13 on the insulating layer 21. Such legs provide support throughout the area extent of the face and thus assure that the vacuum within the space between the electrode gates and the phosphor stripes will not result in deleterious distortion of the face plate.

The matrix array of cathodes is most easily activated by addressing the orthogonally related cathode bases and gates in a generally conventional matrix-addressing scheme. The orthogonal relationship of the base and gate drives is schematically represented in FIG. 1 by diagrammatic blocks 28 and 29. (Three flow lines extend from the gate drive block 29 to the display whereas only one is shown extending between the base drive block 28 and the display, in order to illustrate their relationship, i.e., there are three gates to be individually energized for each base.)

Figure 4:
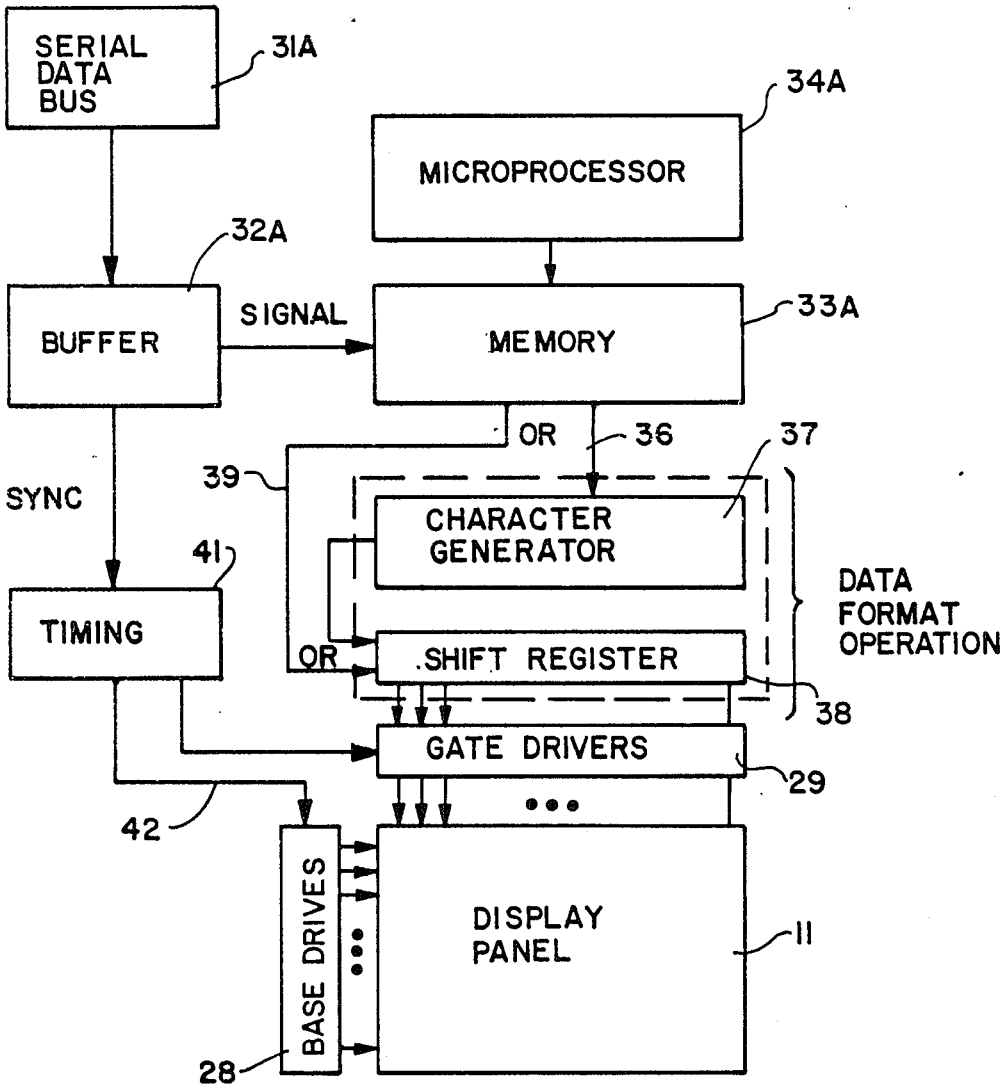
FIG. 4 is a schematic block diagram view of the preferred embodiment of the invention, showing the addressing scheme.

FIG. 4 illustrates blocks 28 and 29 incorporated into a standard matrix-addressing scheme. A serial data bus represented at 31A feeds digital data defining a desired display through a buffer 32A to a memory represented at 33A. A microprocessor 34A also controls the output of memory 33A. If the information defines an alphanumeric character, the output is directed as represented by line 36 to a character generator 37 which feeds the requisite information defining the desired character to a shift register 38 which controls operation of the gate drive circuitry. If, on the other hand, the information defines a display which is not an alphanumeric character, such information is fed directly from the memory 33A to shift register 38 as is represented by flow line 39.

Timing circuitry represented at 41 controls operation of the gate drive circuitry, which operation is synchronized with base energization as represented by flow line 42. The appropriate cathode bases of the display along a selected path, such as along one column, will be energized while the remaining bases will not be energized. Gates of a selected path orthogonal to the base path also will be energized while the remaining gates will not be energized, with the result that the base and gates of a selected pixel will be simultaneously energized to produce electrons to provide the desired pixel display. It should be noted that it is preferable in the instant invention that an entire line of pixels be simultaneously energized, rather than energization of individual pixels as is more conventional. Sequential lines then can be energized to provide a display frame as opposed to sequential energization of individual pixels in a raster scan manner. This will assure that each pixel will have a long duty cycle for enhanced brightness.

Figure 5:
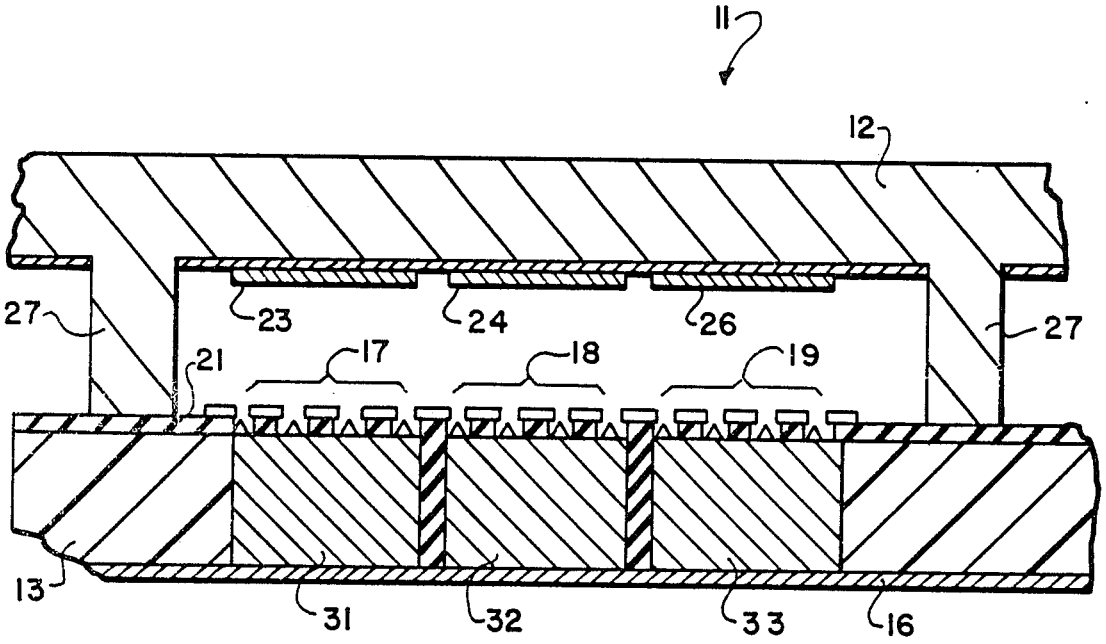
FIG. 5 is an enlarged isometric view similar to a portion of FIG. 2 illustrating an alternate construction.

An alternative construction is illustrated in FIG. 5. Such figure is an isometric view similar to a portion of the base and gate component illustrated in FIG. 2 of the embodiment of FIGS. 1–4. The only significant differences between the earlier embodiment and that represented by FIG. 5 is that rather than a common base and three gates being provided for a single pixel, separate bases 31, 32, and 33 which are physically separated from one another and a common gate 34 are provided. It will be noted that the formation of reverse bias pn junctions between the diffused regions which provide the separate bases, is particularly desirable in connection with this embodiment. Parts which are similar to the previously described embodiment are referred to by like reference numerals.

While the invention has been described in connection with preferred embodiments thereof, it will be appreciated by those skilled in the art that various changes can be made without departing from its spirit. For example, although preferably the features of the invention are incorporated into a cathodoluminescent flat panel display having cathodes of the field emission type, they are applicable to other kinds of flat panel displays. Gates 17 through 19 also may be driven from electrical connections which are diffused or extend through the backing structure 13. Moreover, although a specific addressing technique and circuitry are described, it will be appreciated that the invention is equally applicable to other matrix-addressing arrangements. It is intended that the coverage afforded applicant be defined by the claims and the equivalent language and structure.

What is claimed is:

1. A flat panel display comprising:

A. a backing structure of a semiconductive material of a first conductivity type;

B. a transparent face structure spaced a selected distance from said backing structure;

C. a matrix array of individually addressable light generating means positioned between said backing structure and said face structure;

D. electrical drive means for energizing selected ones of said light generating means of said matrix array; and E. electrical connections for each of said light generating means extending through said backing structure and fabricated of a semiconductive material of a second conductivity type opposite the conductivity type of said first-mentioned semiconductive material.

2. A flat panel display according to claim 1 wherein said matrix array of individually addressable light generating means comprises a matrix array of individually addressable cathodes positioned between said backing structure and said face structure, and luminescing means at said transparent face structure which reacts to bombardment by electrons emanating from said cathodes by emitting visible light, said luminescing means including electrically conductive means for attracting electrons.

3. A flat panel display according to claim 2 wherein each of said cathodes includes:

A. an electrically conductive base at said backing structure having one or a multitude of spaced apart electron emitting tips projecting therefrom and connected to a respective electrical connection;

B. an electrically conductive gate positioned adjacent said tips to generate and control electron emission therefrom, said gate including apertures through which electrons emitted by said tips pass; and C. a first electrical insulating layer electrically separating said base from said gate.

4. A flat panel display according to claim 2 wherein said first conductivity type is an n type and said second conductivity type is a p type, said electrical drive means reverse biasing a selected pn junction defined therebetween to provide electrical energy to the respective light generating means.

5. A flat panel display according to claim 2 comprising a chromatic display defined by pixels and wherein said array of individually addressable light generating means forms pixels and each pixel of said display includes three cathodes having bases which are electrically separated from one another.

6. A flat panel display according to claim 2 wherein the interelectrode spacing between said cathode array and said electrically conductive means is equal to or less than the mean free path of electrons in said interelectrode spacing.

7. A flat panel display according to claim 2 wherein said display is a color display comprising a matrix of color pixels, each one of which includes three of said cathodes.

8. A flat panel display comprising:

A. a backing structure of a semiconductive material of a first conductivity type;

B. a transparent face structure;

C. support means for maintaining said backing structure and said transparent face structure in a spaced apart and hermetically sealed relationship relative to one another, the volume defined therebetween evacuated relative ambient pressure;

D. a matrix array of individually addressable cathodes positioned between said backing structure and said face structure;

E. luminescing means at said transparent face structure which reacts to bombardment by electrons emanating from said cathodes by emitting visible light, said luminescing means including electrically conductive means for attracting electrons;

F. electrical drive means for energizing selected cathodes in said array; and

G. electrical connections for each of said light generating means extending through said backing structure and fabricated of a semiconductive material of a second conductivity type opposite the conductivity type of said first-mentioned semiconductive material.

H. the distance between said array and said conductive means being equal to or less than the mean free path of electrons at the pressure in the interelectrode space.

9. A flat panel display according to claim 8 wherein each of said individually addressable cathodes comprises:

A. an electrically conductive base at said backing structure having a multitude of spaced apart electron emitting tips projecting therefrom;

B. an electrically conductive gate positioned adjacent said tips to generate and control electron emission therefrom, said gate including apertures through which electrons emitted by said tips pass; and C. a first electrical insulating layer electrically separating said base from said gate.

10. A flat panel display according to claim 2 wherein an electrical connection is electrically connected to said individually addressable cathodes.

11. A flat panel display according to claim 3 further comprising spacers elements interspersed between cathodes of said array to maintain a predetermined and fixed spacing between said transparent face structure and said cathodes.

12. A flat panel display comprising:

A. a backing structure of a semiconductive material of an n conductivity type;

B. a transparent face structure having luminescing means which reacts to bombardment by electrons by emitting visible light, said luminescing means including electrically conductive means at said face structure for attracting electrons;

C. a matrix array of individually addressable cathodes positioned between said backing structure and said face structure to provide electrons for said bombardment of said luminescing means, each of said cathodes including:

1. an electrically conductive base at said backing structure having one or a multitude of spaced apart electron emitting tips projecting therefrom;
2. an electrically conductive gate positioned adjacent said tips to generate and control electron emission therefrom, said gate including apertures through which electrons emitted by said tips pass; and
3. a dielectric insulating layer electrically separating said base from said gate;

D. electrical drive means for supplying electrical energy to selected cathodes of said array;

E. support means for maintaining said backing structure and said transparent face structure in a spaced apart and hermetically sealed relationship relative to one another, the volume defined therebetween evacuated relative ambient pressure;

F. electrical connections extending through said backing structure for each of said cathodes, each of said electrical connections being of a p type conductive section, a reverse bias pn junction being formed between the p and n conductivity materials to electrically isolate each p type conductive section from adjacent n type conductive sections of said backing to thereby provide an insulation barrier; and G. spacer elements for maintaining the electrically conductive means at said transparent face of said luminescing means at a fixed spacing relative to said cathode array equal to or less than the mean free path of electrons travelling between said cathode array and said conductive means.

* * * * *